US009434902B2

(12) United States Patent
Niitsuma et al.

(10) Patent No.: US 9,434,902 B2
(45) Date of Patent: Sep. 6, 2016

(54) METHOD FOR PRODUCING JET FUEL COMPOSITION, AND JET FUEL COMPOSITION

(71) Applicant: JX NIPPON OIL & ENERGY CORPORATION, Tokyo (JP)

(72) Inventors: Takuya Niitsuma, Yokohama (JP); Marie Iwama, Yokohama (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 114 days.

(21) Appl. No.: 14/389,473

(22) PCT Filed: Jan. 15, 2013

(86) PCT No.: PCT/JP2013/000128

§ 371 (c)(1),
(2) Date: Sep. 30, 2014

(87) PCT Pub. No.: WO2013/145504

PCT Pub. Date: Oct. 3, 2013

(65) Prior Publication Data

US 2015/0090632 A1 Apr. 2, 2015

(30) Foreign Application Priority Data

Mar. 30, 2012 (JP) ..... 2012-079600

(51) Int. Cl.
*C10L 1/04* (2006.01)
*C10L 10/16* (2006.01)
*C10L 1/08* (2006.01)

(52) U.S. Cl.
CPC ..... *C10L 10/16* (2013.01); *C10L 1/04* (2013.01); *C10L 1/08* (2013.01); *C10G 2300/1022* (2013.01); *C10G 2300/304* (2013.01); *C10G 2300/308* (2013.01); *C10G 2400/08* (2013.01); *C10L 2200/0453* (2013.01); *C10L 2200/0492* (2013.01); *C10L 2270/04* (2013.01); *C10L 2290/24* (2013.01)

(58) Field of Classification Search
CPC .. C10L 10/16; C10L 1/08; C10L 2200/0453; C10L 2200/0492; C10L 2270/04; C10G 2300/304; C10G 2300/308; C10G 2300/1022; C10G 2400/08
See application file for complete search history.

(56) References Cited

U.S. PATENT DOCUMENTS

2006/0111599 A1 5/2006 Lamprecht et al.
2008/0287717 A1 11/2008 Kuechler et al.
2009/0013590 A1 1/2009 Lamprecht et al.
2009/0250376 A1 10/2009 Brandvold et al.
2010/0264061 A1 10/2010 Viljoen et al.
2011/0237850 A1* 9/2011 Luetkens, Jr. ..... C10L 1/04 585/240

FOREIGN PATENT DOCUMENTS

CN 1780899 A 5/2006
JP A-2004-323626 11/2004
JP A-2006-522859 10/2006
WO 2004/090078 A1 10/2004
WO WO 2007/055935 A2 * 5/2007 ..... C10L 1/02

OTHER PUBLICATIONS

Oct. 1, 2014 International Preliminary Report on Patentability issued in International Application No. PCT/JP2013/000128 (with translation).

Oct. 14, 2015 Extended European Search Report issued in European Patent Application No. 13770267.6.

"Annual Book of ASTM Standards," *An American National Standard*, 2000, Vo. 5, No. 01, D1655, pp. 574-584.

Meyer et al., "Emissions Characteristics of a Turbine Engine and Research Combustor Burning a Fischer-Tropsch Jet Fuel," *Energy & Fuels*, 2007, Vo. 21, pp. 2615-2626.

Apr. 23, 2013 International Search Report issued in International Application No. PCT/JP2013/000128.

May 19, 2015 Office Action issue in Japanese Application No. 2012-079600.

Jan. 13, 2015 Office Action issued in Japanese Application No. 2012-079600.

Sep. 16, 2015 Office Action issued in Chinese Patent Application No. 201380017786.1.

Apr. 8, 2016 Office Action issued in Vietnamese Application No. 1-2014-03297.

Apr. 25, 2016 Office Action issued in Chinese Application No. 201380017786.1.

Jun. 27, 2016 Office Action issued in European Application No. 13770267.6.

* cited by examiner

*Primary Examiner* — Brian McCaig
(74) *Attorney, Agent, or Firm* — Oliff PLC

(57) ABSTRACT

An object is to provide a method for producing a jet fuel composition capable of producing a jet fuel composition with excellent quality at a high yield even when a jet fuel blendstock derived from an FT synthesis oil is used, and a jet fuel composition produced by the production method. It is characterized by including a step of mixing a certain Fischer Tropsch (FT) synthesis jet fuel blendstock with a certain petroleum based jet fuel blendstock so that the ratio of the FT synthesis jet fuel blendstock in the composition ranges from 20 to 80% by volume.

3 Claims, No Drawings

METHOD FOR PRODUCING JET FUEL COMPOSITION, AND JET FUEL COMPOSITION

TECHNICAL FIELD

This invention relates to a method for producing a jet fuel composition, and a jet fuel composition, particularly a method for producing a jet fuel composition capable of producing a jet fuel composition with excellent quality even when a jet fuel blendstock derived from FT synthesis oil is used, and a jet fuel composition produced by the same production method.

BACKGROUND ART

Conventionally, with a purpose of the effective use of non-petroleum based fuel oil, a method for producing aviation fuel (jet fuel) using a blendstock with a low sulfur content is known.

For example, Japanese Translation of PCT International Application Publication No. 2006-522859 (PTL 1) discloses a method for producing aviation fuel using a low temperature Fischer Tropsch raw material. Specifically, it is a method for producing low sulfur synthesis diesel fuel and low soot and smoke emitting aviation fuel from a low temperature Fischer Tropsch (LTFT) raw material, for producing a light kerosene fraction capable of being used as low soot and smoke emitting aviation fuel and/or aviation fuel blend stock, and a heavy diesel fraction capable of being used as low sulfur synthesis diesel fuel and/or diesel fuel blend stock, including rectification of a low temperature Fischer Tropsch raw material into a light kerosene fraction and a heavy diesel fraction with a volume ratio of 1:2 to 5:4, wherein the fractions substantially meet diesel fuel and aviation fuel standards.

However, when jet fuel with a low sulfur content is produced using Fischer Tropsch synthesis oil (hereinafter, referred to as "FT synthesis oil"), since the FT synthesis oil is paraffinic, the FT synthesis oil is required to be hydrogenation transformed to have sufficient quality to be used as jet fuel. This is because the freezing point is high when it remains paraffinic, and it cannot be applied to jet fuel requiring a low freezing point, so a step of conducting hydroconversion hydrogenation transformation treatment (hereinafter, referred to as "hydrogenation treatment") to lower the freezing point of the FT synthesis oil is required. In addition, the hydrogenation treatment of the invention includes, for example, hydroisomerization and hydrocracking.

When quality improvement (e.g., decrease in the freezing point) of the produced jet fuel blendstock is attempted by the FT synthesis oil hydrogenation treatment described above, since quality improvement and yield increase of the jet fuel blendstock are in the relationship of trade off, there has been a problem in that the yield of the jet fuel blendstock obtained with respect to the amount of FT synthesis oil decreases. Therefore, development of a technique capable of producing a jet fuel blendstock derived from FT synthesis oil at a good yield, and also producing jet fuel with a sufficiently good quality (e.g., meeting jet fuel standards) using the jet fuel blendstock derived from FT synthesis oil has been desired.

CITATION LIST

Patent Literature

PTL 1: Japanese Translation of PCT International Application Publication No. 2006-522859

SUMMARY OF THE INVENTION

Technical Problem

The invention is developed in consideration of the above circumstance, and has an object to provide a method for obtaining an FT synthesis jet fuel blendstock at a high yield and producing a jet fuel composition with excellent quality even when a jet fuel blendstock derived from FT synthesis produced under the condition of having a particular property is used, and a jet fuel composition produced by the same production method.

Solution to Problem

The inventors have, as a result of devoted studies on the above problem, found that by mixing a jet fuel blendstock derived from FT synthesis oil having a particular property (hereinafter, referred to as "FT synthesis jet fuel blendstock") and a petroleum based jet fuel blendstock having a particular property so that the ratio of the FT synthesis jet fuel blendstock in the composition ranges from 20 to 80% by volume, the condition of hydrogenation treatment required to apply the FT synthesis jet fuel blendstock to jet fuel is moderated as compared to the case of using FT synthesis jet fuel blendstock independently; accordingly, the FT synthesis jet fuel blendstock can be obtained at a higher yield than conventional; and the quality of the obtained jet fuel composition can also be maintained at a high standard.

The invention is made based on such findings, and the summary is as follows.

(1) A method for producing a jet fuel composition, including a step of mixing a Fischer Tropsch (FT) synthesis jet fuel blendstock having a density at 15° C. of 0.720 to 0.780 g/cm$^3$, a flash point of 38 to 48° C. and a freezing point of −47 to −43° C. with a petroleum based jet fuel blendstock having a density at 15° C. of 0.770 to 0.850 g/cm$^3$, a flash point of 40 to 48° C., a freezing point of −70 to −50° C. and an aromatic content of 10 to 30% by volume so that the ratio of the FT synthesis jet fuel blendstock in the composition ranges from 20 to 80% by volume.

(2) A method for producing a jet fuel composition according to the above item (1), wherein the FT synthesis jet fuel blendstock has a 5% distillation temperature of 160 to 180° C. and a 90% distillation temperature of 210 to 225° C.

(3) A jet fuel composition obtained by the production method according to the above item (1), wherein the density at 15° C. is 0.760 to 0.785 g/cm$^3$, the sulfur content is not more than 0.3% by mass, the aromatic content is 5 to 30% by volume, the flash point is 38 to 43° C., and the freezing point is −50 to −45° C.

Effect of the Invention

According to the invention, a jet fuel blendstock derived from FT synthesis oil obtained at a higher yield than conventional art can be used, and also it is possible to produce a jet fuel composition with excellent quality even when the jet fuel blendstock derived from FT synthesis oil is used.

DESCRIPTION OF EMBODIMENTS

Below, the invention will specifically be described.

The method for producing a jet fuel composition according to the invention is characterized by mixing a synthesis jet fuel blendstock having a particular property with a petroleum based jet fuel blendstock having a particular property so that the ratio of the FT synthesis jet fuel blendstock in the jet fuel composition ranges from 20 to 80% by volume.

By mixing the synthesis jet fuel blendstock with the petroleum based jet fuel blendstock in the above ratio, the conditions of hydrogenation treatment required to apply a blendstock having the FT synthesis jet fuel blendstock and the petroleum based jet fuel blendstock mixed (hereinafter, referred to as "mixed blendstock") to jet fuel can be significantly moderated as compared to the case of using the FT synthesis jet fuel blendstock. Moreover, since the conditions of the hydrogenation treatment are moderated, the FT synthesis jet fuel blendstock can be obtained at a higher yield than conventional.

For example, since the reaction temperature for hydrogenation for treating the mixed blendstock does not need to be higher than necessary, degradation of the FT synthesis jet fuel blendstock can be suppressed and the yields of a naphtha fraction and a gas fraction can be suppressed as compared to the case of using the FT synthesis jet fuel blendstock independently, the yield of the FT synthesis jet fuel blendstock obtained from the FT synthesis oil can significantly be improved.

Moreover, in the invention, since optimization is attempted for each property of the FT synthesis jet fuel blendstock and the petroleum based jet fuel blendstock, not only the yield of the FT synthesis jet fuel blendstock can be increased, but also the quality of the obtained jet fuel composition becomes good. Furthermore, since the hydrogenation treatment conditions of the FT synthesis jet fuel blendstock can be moderated, special effects are achieved, that is, the production cost can also be reduced and it is possible to suppress consumption of the petroleum based fuel blendstock using the FT synthesis jet fuel blendstock in terms of alternative fuel for petroleum.

In mixing, the ratio of the FT synthesis jet fuel blendstock with respect to the mixed blendstock ranges from 20 to 80% by volume; since when the ratio is less than 20% by volume, the petroleum based jet fuel blendstock is too much, and use of the FT synthesis jet fuel blendstock is not sufficient. On the other hand, since when the ratio is more than 80% by volume, the FT synthesis based jet fuel blendstock is too much, in order to make the quality of the finally obtained jet fuel composition good, it becomes necessary to improve the quality of the FT synthesis based jet fuel blendstock, the effect of moderating the hydrogenation treatment condition of the FT synthesis based jet fuel blendstock becomes small, the production cost rises accordingly and the yield of the FT synthesis based jet fuel blendstock also decreases; thus, the production cost of the finally obtained jet fuel composition also tends to increase.

In addition, in terms of realizing a higher yield of the FT synthesis jet fuel blendstock and using more of the FT synthesis jet fuel blendstock as a blendstock of the jet fuel composition, the ratio of the synthesis jet fuel blendstock preferably ranges from 30 to 80% by volume, more preferably ranges from 40 to 80% by volume, and further preferably ranges from 60 to 80% by volume.

(FT Synthesis Jet Fuel Blendstock)

The FT synthesis jet fuel blendstock used in the production method of the invention has a density at 15° C. of 0.720 to 0.780 g/cm$^3$, a flash point of 38 to 48° C., and a freezing point of −47 to −43° C.

The density at 15° C. of the FT synthesis jet fuel blendstock is 0.720 to 0.780 g/cm$^3$, and preferably 0.745 to 0.755 g/cm$^3$. With a small density, an easily volatilizing component tends to increase, while in terms of easier handling, a volatile component is preferably not too much, so the density at 15° C. is not less than 0.720 g/cm$^3$. Also, with a large density, an easily freezing component tends to increase, while an easily freezing component is preferably not much in the jet fuel blendstock, so the density at 15° C. is not more than 0.780 g/cm$^3$.

The flash point of the FT synthesis jet fuel blendstock is 38 to 48° C., and preferably 40 to 45° C. The flash point is not less than 38° C. in terms of easier handling, and it is not more than 48° C. in terms of better ignitability.

The freezing point of the FT synthesis jet fuel blendstock is −47 to −43° C., preferably −47 to −45° C., and more preferably −46 to −45° C. When an aircraft using jet fuel is flying in the air, in order for an easily freezing component such as a wax fraction not to freeze out within the tank of the aircraft, the freezing point is required to be not more than −43° C. Also, in order for the yield of the FT synthesis jet fuel blendstock to be high, the freezing point is not less than −47° C.

Moreover, the 5% distillation temperature of the FT synthesis jet fuel blendstock is preferably 160 to 180° C., and more preferably 165 to 170° C. The 5% distillation temperature is preferably not less than 160° C. in terms of not having too much of an easily volatilizing component and making the handling of the FT synthesis jet fuel blendstock easier, and it is preferably not more than 180° C. in terms of increasing the yield of the FT synthesis jet fuel blendstock.

Furthermore, the 90% distillation temperature of the FT synthesis jet fuel blendstock is preferably 210 to 225° C., and more preferably 215 to 225° C. In order to increase the yield of the FT synthesis jet fuel blendstock, the 90% distillation temperature is preferably not less than 210° C., and in order to decrease an easily freezing component, it is better that a heavy fraction is less, and the 90% distillation temperature is preferably not more than 225° C. In addition, the 95% distillation temperature is preferably within a range of 225 to 230° C.

Also, in the FT synthesis jet fuel blendstock, in order to reduce the sulfur oxide amount and particulate matters in exhaust gas, the sulfur content is preferably not more than 1% by mass and the aromatic content is preferably not more than 1% by mass.

In addition, a method for producing the FT synthesis jet fuel blendstock is not particularly limited as long as the above properties can be obtained.

For example, it can be produced by a production method including steps of fractionating an FT synthesis oil into a light fraction and a wax fraction, hydroisomerizing for treating the light fraction to obtain a hydroisomerized oil, hydrocracking for treating the wax fraction to obtain a hydrocracked oil, mixing the hydroisomerized oil and the hydrocracked oil and then supplying it to a product fractionator, and adjusting the cutting temperature at the product fractionator so as to obtain a kerosene composition of the invention. Moreover, it is preferable that a bottom oil of the product fractionator is recycled, mixed with the wax fraction and then hydrocracked.

The yield of the FT synthesis jet fuel blendstock derived from the FT synthesis oil is not particularly limited, but is preferably 30 to 70% by volume, and more preferably 35 to 65% by volume, based on the FT synthesis oil standards. Since the yield of the FT synthesis based jet fuel blendstock is better to be high, it is preferably not less than 35% by volume, while since it is difficult to be above 70% by volume based on the FT synthesis reaction theory, the yield of the FT synthesis based jet fuel blendstock is preferably not more than 70% by volume.

(Petroleum Based Jet Fuel Blendstock)

The petroleum based jet fuel blendstock used in the production method of the invention has a density at 15° C. of 0.770 to 0.850 g/cm$^3$, a flash point of 40 to 48° C., a freezing point of −70 to −50° C., and an aromatic content of 10 to 30% by volume.

The density at 15° C. of the petroleum based jet fuel blendstock is 0.770 to 0.850 g/cm$^3$, and preferably 0.785 to 0.815 g/cm$^3$. When the density of the petroleum based jet fuel blendstock is small, an easily volatilizing component tends to increase, while in terms of easier handling, a volatile component is better not to be too much, so the density at 15° C. is not less than 0.770 g/cm$^3$. On the other hand, with a large density, an easily freezing component tends to increase, and an easily freezing component is better not to be much as a jet fuel blendstock, so the density at 15° C. is not more than 0.850 g/cm$^3$.

The flash point of the petroleum based jet fuel blendstock is 40 to 48° C., and preferably 40 to 45° C. The flash point is not less than 40° C. in terms of easier handling, and it is not more than 48° C. in terms of better ignitability.

The freezing point of the petroleum based jet fuel blendstock is −70 to −50° C., and preferably −65 to −52° C. When an aircraft using jet fuel is flying in the air, in order for an easily freezing component such as a wax fraction not to freeze out within the tank of the aircraft, the freezing point is required to be not more than −50° C. Also, in order to increase the yield of the FT synthesis jet fuel blendstock used as a mixed blendstock with the petroleum based jet fuel blendstock, the freezing point is not less than −70° C.

The aromatic content of the petroleum based jet fuel blendstock is 10 to 30% by volume, and preferably 15 to 25% by volume. When the jet fuel composition of the invention is used, the aromatic content is not less than 10% by volume in order to make the sealing property of the rubber member better, and it is not more than 30% by volume in terms of reducing particulate matters in exhaust gas.

Moreover, the 10% distillation temperature of the petroleum based jet fuel blendstock is preferably 155 to 175° C., and more preferably 160 to 170° C. The 10% distillation temperature is preferably not less than 155° C. in terms of not having too much of an easily volatilizing component and making the handling of the petroleum based jet fuel blendstock easier, and it is preferably not more than 175° C. in terms of increasing the yield of the FT synthesis jet fuel blendstock.

Furthermore, the 90% distillation temperature of the petroleum based jet fuel blendstock is preferably 215 to 250° C., and more preferably 220 to 245° C. In order to increase the yield of the FT synthesis jet fuel blendstock, the 90% distillation temperature is preferably not less than 215° C., and in order to decrease an easily freezing component, it is better that a heavy fraction is less, and the 90% distillation temperature is preferably not more than 250° C. In addition, the end point is preferably 255.0 to 257.5° C.

In addition, a method for producing the petroleum based jet fuel blendstock is not particularly limited as long as the above properties can be obtained.

For example, it can be produced by treating crude oil with an atmospheric distillator, and hydrogenating the obtained directly distilled kerosene fraction with a kerosene desulfurizer. Also, in order to obtain the properties described above, the petroleum based jet fuel blendstock can be prepared by blending blendstocks obtained from each apparatus of a petroleum purification plant, or a solvent can be added thereto as appropriate.

(Jet Fuel Composition)

The jet fuel composition of the invention produced by the production method described above is characterized by high quality.

Moreover, the density at 15° C. of the jet fuel composition of the invention is 0.760 to 0.785 g/cm$^3$, and preferably 0.770 to 0.780 g/cm$^3$. In order for the flash point to be not too low, and also in order for fuel efficiency upon being used for a jet engine to be good, it is preferably not less than 0.760 g/cm$^3$, and in order for the heavy component to be much and the freezing point not to be too high, it is preferably not more than 0.780 g/cm$^3$.

Furthermore, the 5% distillation temperature of the jet fuel composition of the invention is 160 to 175° C., and preferably 165 to 170° C. The 90% distillation temperature is 220 to 240° C., and preferably 225 to 235° C. The 95% distillation temperature is preferably 235 to 250° C. In addition, when the 5% distillation temperature is less than 160° C., the flash point would be too low, and when it is more than 175° C., the ignitability decreases. Also, when the 95% distillation temperature is less than 235° C., the fuel efficiency of a jet engine decreases, and when it is more than 250° C., the freezing point would be too high. Therefore, each distillation temperature is preferably set within the above range.

Moreover, the freezing point of the jet fuel composition of the invention is −50 to −45° C., and preferably −49 to −48° C. The flash point is 38 to 43° C., and preferably 40 to 43° C. The freezing point is not less than −50° C. for making the production cost good, and not more than −45° C. for making the low temperature property good.

Furthermore, the sulfur content of the jet fuel composition of the invention is not more than 0.3% by mass, and preferably not more than 0.1% by mass. The sulfur content is not more than 0.3% by mass for further reducing the sulfur content in exhaust gas of a jet engine.

Also, the aromatic content is 5 to 20% by volume, preferably 5 to 15% by volume, and more preferably 8 to 12% by volume. It is not less than 5% by volume for making the rubber swelling property upon being used for a jet engine good, and it is not more than 20% by volume for reducing particulate matters (PM) in exhaust gas of a jet engine.

The above description only illustrates one example of embodiments of the invention, and various modifications can be added according to the description of the claims.

EXAMPLES

Below, although the invention will be described in further detail with reference to Examples, the invention is not limited to any of the following Examples.

It should be noted that analysis methods for each property in Examples are as follow.

Sulfur content: Measured according to JIS K 2541

Aromatic content: Measured according to JIS K 2536-3

Distillation property: Measured according to JIS K 2254

Density: Measured according to JIS K 2249 "Crude petroleum and petroleum products—Determination of density and petroleum measurement tables based on a reference temperature (15° C.)"

Flash point: Measured according to JIS K 2265 "Crude oil and petroleum products—Determination of flash point"

Cloud point: Measured according to JIS K 2269 "Testing Methods for Pour Point and Cloud Point of Crude Oil and Petroleum Products"

Freezing point: Measured according to JIS K 2276 "Petroleum Products—Testing Methods for Aviation Fuels"

(Fuel Blendstock)

(1) FT synthesis jet fuel blendstocks 1 and 2 were prepared according to the following procedures.

A hydroisomerized oil obtained by using an FT synthesis oil obtained by an FT synthesis reaction and hydroisomerization for treating (LHSV: 2.0 h−1, hydrogen partial pressure: 3.0 MPa, reaction temperature: see Table 1) a light fraction of the FT synthesis oil and a hydrocracked oil obtained by hydrocracking (LHSV: 2.0 h−1, hydrogen partial pressure: 4.0 MPa, reaction temperature: 310° C.) a wax fraction of the FT synthesis oil while recycling (recycling ratio: 55 vol %) a bottom oil (fraction at the cutting temperature: not less than 360° C.) of the product fractionator were mixed and supplied to the product fractionator. The cutting temperatures of a naphtha fraction at the product fractionator and the FT synthesis jet fuel blendstock of the invention were constant at 150° C.

(2) Also, a petroleum based jet fuel blendstock 1 with properties shown in Table 1 was prepared.

Moreover, the hydroisomerization reaction temperature (° C.) and the hydrocrack reaction temperature (° C.) of the FT synthesis jet fuel blendstocks 1 and 2, the naphtha yield (vol %) of the FT synthesis oil standards and the yield (vol %) of the jet fuel blendstock are shown in Table 1.

In addition, properties (density at 15° C., sulfur content, aromatic content, flash point, freezing point, distillation properties, 5% distillation temperature, 10% distillation temperature, 30% distillation temperature, 50% distillation temperature, 70% distillation temperature, 90% distillation temperature, 95% distillation temperature and end point) of each fuel blendstock are also shown in Table 1.

TABLE 1

| | | Petroleum Based Jet Fuel Blendstock 1 | FT Synthesis Jet Fuel Blendstock 1 | FT Synthesis Jet Fuel Blendstock 2 |
|---|---|---|---|---|
| Hydroisomerization Reaction Temperature | ° C. | — | 328 | 345 |
| Hydrocrack Reaction Temperature | ° C. | — | 310 | 310 |
| Naphtha Yield | vol % | — | 24 | 36 |
| Jet Fuel Blendstock Yield | vol % | — | 38 | 26 |
| Density (15° C.) | g/cm$^3$ | 0.794 | 0.748 | 0.758 |
| Sulfur Content | mass % | 0.1 | <1 | <1 |
| Aromatic Content | vol % | 19 | <1 | <1 |
| Flash Point | ° C. | 42 | 43 | 46 |
| Freezing Point | ° C. | −52 | −45 | −51 |
| 5% Distillation Temperature | ° C. | 162.0 | 169.5 | 183.5 |
| 10% Distillation Temperature | ° C. | 166.0 | 175.0 | 189.0 |
| 30% Distillation Temperature | ° C. | 178.5 | 186.0 | 202.0 |
| 50% Distillation Temperature | ° C. | 191.5 | 195.5 | 215.0 |
| 70% Distillation Temperature | ° C. | 208.0 | 207.0 | 231.0 |
| 90% Distillation Temperature | ° C. | 232.5 | 221.5 | 252.5 |
| 95% Distillation Temperature | ° C. | 243.0 | 226.5 | 260.5 |
| End Point | ° C. | 260.0 | 237.0 | 268.0 |

Examples 1 to 5, Comparative Example 1

Based on the mixing ratio shown in Table 2, a petroleum based jet fuel blendstock and an FT synthesis jet fuel blendstock were mixed to obtain a jet fuel composition.

For the obtained jet fuel compositions, properties were measured (however, for each distillation temperature, only Examples 1 and 3 were measured), and the results are shown in Table 2.

TABLE 2

| | | Example 1 | Example 2 | Example 3 | Example 4 | Example 5 | Comparative Example 1 |
|---|---|---|---|---|---|---|---|
| Petroleum Based Jet Fuel Blendstock 1 | vol % | 60 | 70 | 50 | 40 | 30 | 60 |
| FT Synthesis Jet Fuel Blendstock 1 | vol % | 40 | 30 | 50 | 60 | 70 | 0 |
| FT Synthesis Jet Fuel Blendstock 2 | vol % | 0 | 0 | 0 | 0 | 0 | 40 |
| Density (15° C.) | g/cm$^3$ | 0.776 | 0.780 | 0.771 | 0.765 | 0.760 | 0.779 |
| Sulfur Content | mass % | 0.05 | 0.06 | 0.04 | 0.03 | 0.03 | 0.05 |
| Aromatic Content | vol % | 12 | 13 | 10 | 8 | 6 | 12 |
| Flash Point | ° C. | 42 | 42 | 42 | 43 | 43 | 44 |
| Freezing Point | ° C. | −49 | −49 | −49 | −48 | −47 | −52 |
| 5% Distillation Temperature | ° C. | 165.5 | | 167.0 | | | |
| 10% Distillation Temperature | ° C. | 170.0 | | 171.5 | | | |
| 30% Distillation Temperature | ° C. | 182.5 | | 183.5 | | | |
| 50% Distillation Temperature | ° C. | 194.0 | | 195.0 | | | |

TABLE 2-continued

| | | Example 1 | Example 2 | Example 3 | Example 4 | Example 5 | Comparative Example 1 |
|---|---|---|---|---|---|---|---|
| 70% Distillation Temperature | ° C. | 209.0 | | 209.0 | | | |
| 90% Distillation Temperature | ° C. | 229.0 | | 228.0 | | | |
| 95% Distillation Temperature | ° C. | 237.0 | | 236.0 | | | |
| End Point | ° C. | 252.0 | | 249.5 | | | |

From the results in Table 2, regarding the jet fuel compositions obtained in each Example, it was clear that in addition to the qualities being good, the yields of the FT synthesis jet fuel blendstocks were high. Moreover, as shown in Table 1, since the hydroisomerization reaction temperatures in producing the FT synthesis jet fuel blendstock are lower than in Comparative Example 1, the production cost of the FT synthesis jet fuel blendstock and moreover the production cost of the obtained jet fuel composition can also be reduced.

On the other hand, the jet fuel composition obtained in Comparative Example 1 showed results that the yield with respect to the FT synthesis jet fuel blendstock is lower and the freezing point is higher as compared with Examples, and that the quality is poorer than the jet fuel compositions obtained in Examples.

INDUSTRIAL APPLICABILITY

According to the invention, special effects are performed, that is, it is possible to produce a jet fuel composition with excellent quality even when a jet fuel blendstock derived from an FT synthesis oil is used, and an FT synthesis jet fuel blendstock can easily be used as a blendstock of jet fuel.

The invention claimed is:

1. A method for producing a jet fuel composition, including a step of mixing a Fischer Tropsch (FT) synthesis jet fuel blendstock having a density at 15° C. of 0.720 to 0.780 g/cm$^3$, a flash point of 38 to 48° C. and a freezing point of −47 to −43° C. with a petroleum based jet fuel blendstock having a density at 15° C. of 0.770 to 0.850 g/cm$^3$, a flash point of 40 to 48° C., a freezing point of −70 to −50° C. and an aromatic content of 10 to 30% by volume so that the ratio of the FT synthesis jet fuel blendstock in the composition ranges from 20 to 80% by volume.

2. A method for producing a jet fuel composition according to claim 1, wherein the FT synthesis jet fuel blendstock has a 5% distillation temperature of 160 to 180° C. and a 90% distillation temperature of 210 to 225° C.

3. A jet fuel composition obtained by the production method according to claim 1, wherein the density at 15° C. is 0.760 to 0.785 g/cm$^3$, the sulfur content is not more than 0.3% by mass, the aromatic content is 5 to 30% by volume, the flash point is 38 to 43° C., and the freezing point is −50 to −45° C.

* * * * *